US005788123A

United States Patent [19]

Hackmann et al.

[11] Patent Number: 5,788,123

[45] Date of Patent: Aug. 4, 1998

[54] DISPENSER FOR THE CONTROLLED DISCHARGE OF A FLUID MEDIUM

[75] Inventors: Ludger Hackmann, Lohne; Michael Hahl, Frankfurt am Main, both of Germany

[73] Assignee: Bramlage GmbH, Lohne, Germany

[21] Appl. No.: 495,856

[22] Filed: Jun. 28, 1995

[30] Foreign Application Priority Data

Jul. 6, 1994 [DE] Germany ..... 44 23 608.5

[51] Int. Cl.[6] ..... B67B 5/00

[52] U.S. Cl. ..... 222/153.13; 222/391

[58] Field of Search ..... 222/39, 207, 213, 222/153.13, 509, 391

[56] References Cited

U.S. PATENT DOCUMENTS

| | | | |
|---|---|---|---|
| 4,836,415 | 6/1989 | Grussmark | 222/39 |
| 5,044,523 | 9/1991 | McNab | 222/207 |
| 5,052,592 | 10/1991 | Wilken et al. . | |
| 5,158,206 | 10/1992 | Kobayashi et al. | 222/39 |

FOREIGN PATENT DOCUMENTS

| | | |
|---|---|---|
| 0282791 | 8/1991 | European Pat. Off. . |
| 3045048 | 7/1982 | Germany . |
| 83 07 898.3 | 8/1984 | Germany . |

*Primary Examiner*—Gregory L. Huson

*Attorney, Agent, or Firm*—Hill, Steadman & Simpson

[57] ABSTRACT

A dispenser for paste compositions is formed of a housing having an inside wall formed about a longitudinal axis for containing said compositions and being open at one end. A piston is arranged to move axially within the housing to urge the compositions towards the open end. A locking mechanism supports the piston within the housing against the inside wall and prevents the piston from moving in a direction opposite to a dispensing direction. A head part is arranged at the open end of the housing for displacement of a portion of the composition to be dispensed. A push button is arranged laterally next to the head part for pressing against and deflecting at least a part of the head part The head part has a centrally arranged closing valve formed with a valve body, the valve being opened and closed upon the activation of the push button. A connecting rod passes axially through the housing and is held by a holder positioned in a guide cylinder of the valve body with very little axial free play.

12 Claims, 6 Drawing Sheets

DISPENSER FOR THE CONTROLLED DISCHARGE OF A FLUID MEDIUM

BACKGROUND OF THE INVENTION

The invention is directed to a dispenser for pasty compositions having a housing which contains a piston displacable only in an emptying direction, the piston being supported against the inside wall of the housing in the opposite direction by a locking mechanism, and which, for displacing a portion of the composition to be dispensed, the dispenser comprises a head part that can be pressed together or, respectively, pressed down by a respective stroke of a push button, whereby the push button is arranged laterally next to the head part and the dispenser comprises a centrally arranged closing valve that can be opened or closed together with the actuation of the push button.

EP 0 282 791 B1 discloses a dispenser of this type. In this, a portion of the composition to be dispensed is displaced from the housing content by a respective stroke of the push button given simultaneous opening of a valve arranged in the middle in the head part, this portion emerging at a concave wall of the head part fashioned as a spreader surface. As soon as the push button is relieved and the valve in the head part is closed, a vacuum that draws the piston in emptying direction arises in the fill column under the head part that becomes upright in turn. The portion of paste composition displaced by actuation of the deformable head part is thereby replenished for the next discharge actuation. This means that no air inclusions are allowed to be present in the fill column between the upper side of the piston and the lower side of the head part. Such air inclusions would entirely or partially cancel the pump effect. The known dispenser is consequently filled with the dispenser head pointing down so that air enclosed between piston and filled product can escape. The starting region of the inside wall of the housing is fashioned with longitudinal rifling.

DE 30 45 048 C2 also discloses a dispenser for paste compositions having a piston displaceably arranged in the dispenser housing that migrates in discharge direction and is blocked in the opposite direction, as well as further having a push button actuation at a head member that can be compressed in the fashion of a billows, whereby a connecting rod that penetrates through the piston is connected thereto. The connecting rod is coupled to the piston upon interposition of an axial free-floating piece in the head member. The head member comprises a dispenser mouthpiece opening fashioned channel-like whose orifice can be closed with a plug for storage purposes. This plug is removed when the dispenser is initially used after which the mouthpiece opening remains unclosed for further dispensing. Given a longer interruption in use, this can result in the composition drying in the region of the mouthpiece opening or that composition emerges when the dispenser is stored in horizontal position. Since, after actuation of the head piece, paste composition continues to move forward for some time with decaying elasticity of the righting head member; under these conditions, emergence of composition from the unclosed mouthpiece cannot be precluded.

SUMMARY OF THE INVENTION

The invention is based on the object of developing a dispenser for paste compositions of the above described type and improving it to the effect that the described disadvantages and difficulties are overcome and, in particular, such that no secondary emergence of composition can occur after actuation, such that a reliable replenishment of the portion of composition displaced occurs regardless of slight air inclusions, and such that the dispenser can be cost-beneficially manufactured and assembled with simple structural means.

This object is inventively achieved in that the valve and the piston are coupled by a connecting rod that axially penetrates the housing and the valve, piston and connecting rod interact with one another given every stroke of the push button.

Advantageously in the inventive fashioning of the dispenser, the valve, on the one hand, is opened simultaneously with the actuation of the push button and, on the other hand, a predetermined quantity of composition is discharged from the valve opening through the opened valve and made available. When the push button is relieved, the valve closes and the head part rights itself to its relieved form, drawing the piston with it to such an extent along the connecting rod that the piston replenishes the dispensed composition regardless of a more or less great suction that thereby arises. The free-floating arrangement of the connecting rod connection in the head part thereby produces a shorter stroke distance of the piston compared to a relatively greater actuation stroke given a change in shape of the head part.

A simple and reliably functioning actuation thereby derives with a tight closure of the discharge opening of the dispenser after the actuation, while avoiding secondary emergence or, respectively, drying of the composition.

The demand to employ structurally simple means and an assembly-friendly design is met in that the connecting rod in the head part comprises a holder in the form of a punctured or apertured radial disk with which it is underpinned by the lower edge of the guide cylinder in a guide cylinder of the head part with little axial free play and is clipably held, and has its end part couplable to the piston with positive lock, upon interposition of an inner locking mechanism present at the floor of the piston. The connecting rod can thus be clipped into the guide cylinder without assembly outlay and can be plugged through the piston.

BRIEF DESCRIPTION OF THE DRAWINGS

The invention is shown in preferred embodiments thereof in schematic drawings, whereby further advantageous details of the invention may be derived from the drawing.

DETAILED DESCRIPTION OF THE PREFERRED EMBODIMENTS

Figure 1:
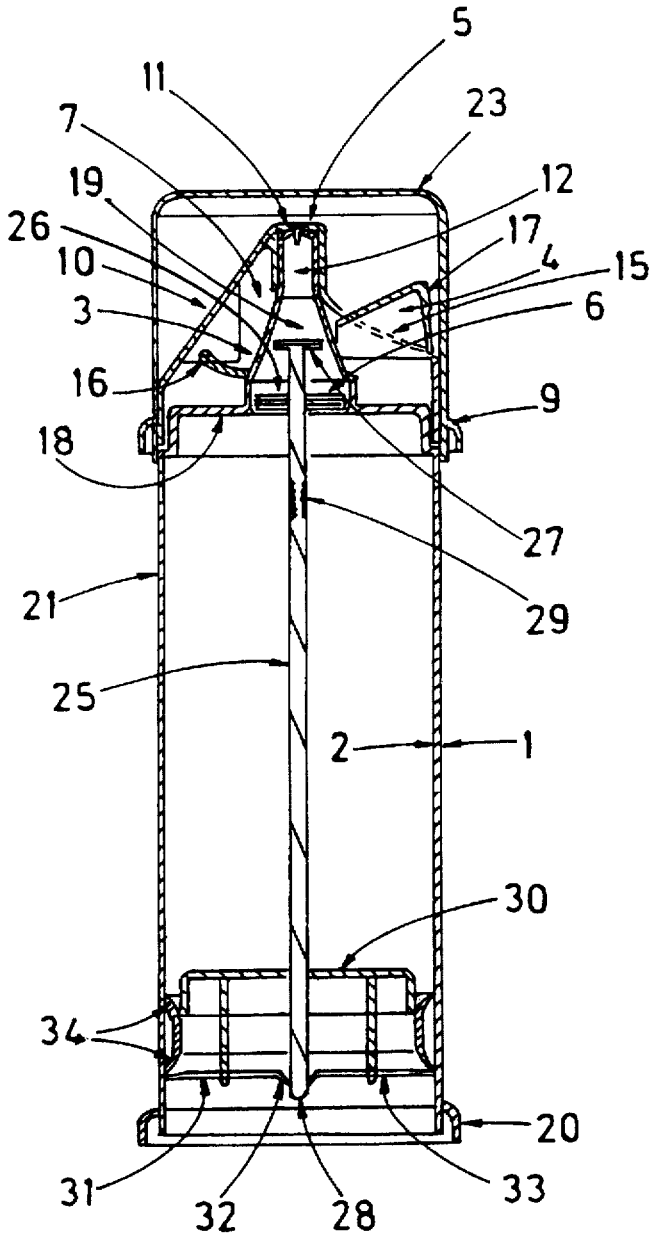
FIG. 1 shows a dispenser embodying the principles of the present invention in longitudinal section.

The dispenser for paste composition shown in FIG. 1 comprises a housing having a piston 30 that can be displaced only in an emptying direction. The piston 30 is supportable against an inside wall 2 of the housing 1 in an opposite direction by a locking mechanism 31. In the standard way, the piston 30 has elastic sealing lips 34 that seal in both directions at its outside circumference. The dispenser comprises a head part 3 that can be pressed together or, respectively, down by a stroke of a push button 4, whereby the push button 4 is arranged laterally next to the head part 3. The head part 3 has a centrally arranged closing valve 5 that can be opened or closed with the actuation of the push button 4. The head part 3 can be covered by a cap 23 allocated to the dispenser.

Inventively, the valve 5 and the piston 30 are coupled by a connecting rod 25 that axially penetrates the housing 1, interacting with one another upon every stroke of the push button 4. The interaction is achieved in that the connecting rod 25 is held in a guide cylinder 6 of the valve body 7 with little axial free play by a holder 26 in the form of a punctured or apertured radial disk. The end part 28 of the connecting rod 25 that faces toward the piston 30 is coupled with a positive lock to the piston 30 upon interposition of a locking mechanism 32 present at a floor 33 of the piston. At every work stroke of the push button 4, the housing cover 18 is pressed down and displaces a predetermined portion of the filling compound in the direction of the closing valve 5. In order to enable this, the housing cover 18 is fashioned extremely elastic in the manner of a membrane having a relatively thin wall thickness, so that it yields under the pressure of the push button 4 and executes, so to speak, a "pump stroke". The housing cover 18, however, has a sufficient restoring force due to its elasticity and resiliency so as to cause it to return to its original position when the force of the push button is relieved. At the same time, the valve mechanism is activated and the valve 5 opens, in that the head part 3 connected to the housing cover 18 together with the funnel-shaped discharge 19 and the discharge tube 12 arranged thereat, slides down in the direction of the arrow 24 within the cap 11 of the applicator 10, as may be seen from the magnified illustration of FIGS. 1*a* and 3, and there disengages the valve plug 14 from its closing position in the valve opening 8 and releases the latter.

An expedient design of the dispenser provides that the housing 1 forms a neck 9 having reduced diameter at the upper region of the housing. The neck 9 accepts the applicator 10, whereby the latter comprises a cylindrical cap 11 provided with a valve opening 8 that opens in downward direction. A small tube 12 forms a part of the valve 5 and extends upward from the head part 3 and slides axially displaceable in telescoping fashion within the cylindrical cap. The small tube 12 carries a valve plug 14 at its tip held in place by star-shaped or spider-type arms 13. In order to prevent filling compound from proceeding into the annular interspace formed between the small tube 12 and the cap 11 when passing from tech small tube 12 into the cap 11, the small tube 12 has an annular, elastic seal bead 50 formed on an outer surface thereof, as may be better seen from FIG. 3. Alternatively, this seal could be provided by a highly elastic sealing lip or an O-ring.

The applicator 10 has a lateral opening 15 within which the push button 4 is arranged, whereby this push button is movably hinged by gusset-like ribs 16 formed inside the applicator 10 at a side opposite the opening 15. At its outside, further, the push button 4 comprises a stop bead 17 fashioned as a stroke-limiting element. The stop bead 17 will engage at the outer edge of the clearance 15 at the limit of its downward stroke. The housing cover 18 is thus prevented from being too greatly deformed and, thus, is prevented from being excessively stretched or, respectively, overstressed.

Figure 1A:
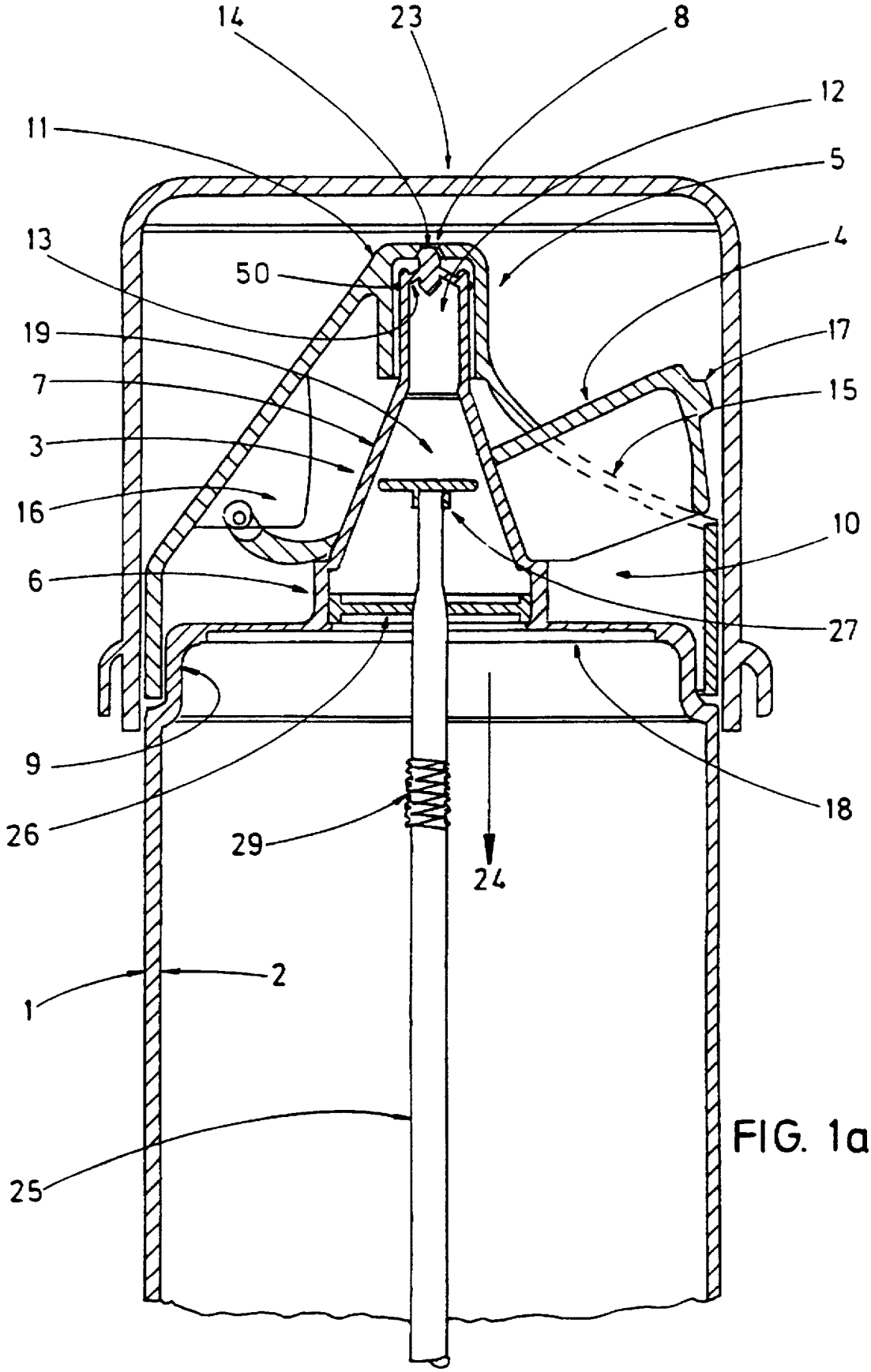
FIG. 1*a* shows the upper part of the dispenser of FIG. 1 in longitudinal section and enlarged.

Given the embodiment shown in FIGS. 1 and 1*a*, the connecting rod 25 projects into the discharge 19 and thus is upwardly extended beyond the holder 26. At its extended free end, it carries a centering plate 27. The centering plate has a valve function in that, when the housing cover 18 is pressed down, an annular gap between the discharge 19 and the centering plate becomes small in size and then blocks, as a result whereof the quantity of filling compound emerging during the working stroke of the button 4 is limited. For the sake of rational manufacture in a plastic injection molding process, and as a result of the possibility of an unproblematical unmolding, the centering plate 27, just like the connecting rod 25, is respectively fashioned as an independent shaped part and the two parts can be connected to one another by plugging or press fit. The joining can thereby be cost-beneficially implemented after manufacture of the two parts as standard in mass production of small parts upon employment of automatic assembly units.

The dispenser includes an advantageous feature in that the connecting rod 25 is provided with a rifling 29 at a region immediately below the neck 9 of the housing 1. When, shortly before complete emptying of the housing the piston 30 slides over this rifling 29, a clicking noise is caused, this indicating that the dispenser is about to be emptied.

The very advantageous embodiment shown in FIG. 1 also provides that the housing 1 with stand base 20, supply cylinder 21, neck 9, cover 18 and head part 3 is integrally composed of medium-hard thermoplastic material. This facilitates assembly, reduces the number of parts belonging to the assembly of the dispenser, and enables extremely economical manufacture given high piece numbers. The more highly stressed elements of the dispenser such as piston 30, applicator 10, push button 4, cap 23, as well as the connecting rod 25, by contrast, can be composed of a comparatively hard thermoplastic material.

FIG. 1*a* shows the upper part of the dispenser in an enlarged view, whereby the placement and arrangement of the afore-mentioned elements can be seen better in this FIG.; all elements are thereby provided with reference characters corresponding to FIG. 1.

Figure 2:
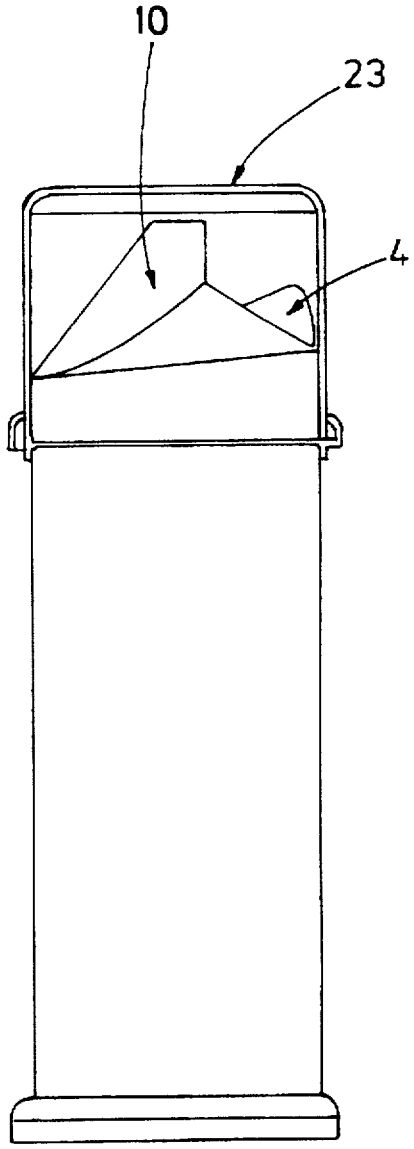
FIG. 2 shows a side elevational view of the dispenser of FIG. 1.

FIG. 2 shows the dispenser in a side view, whereby it is essentially the shape of the applicator 10 that may be seen, for example, through a transparent cap.

Figure 3:
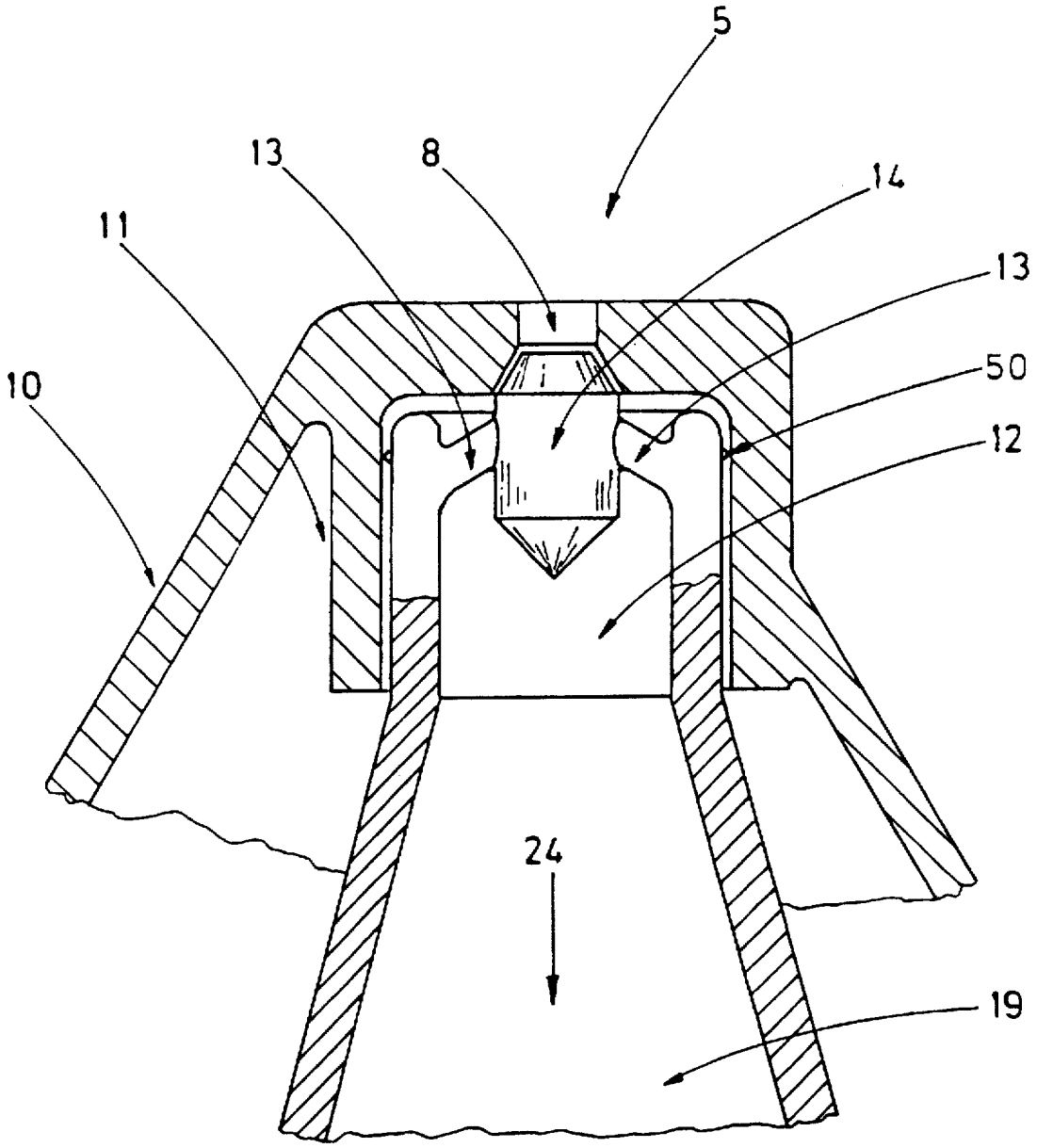
FIG. 3 shows a longitudinal section through the dispenser valve, in a highly magnified scale.

In FIG. 3, which was described in part above, the structure of the valve 5 may be especially clearly seen, likewise in an enlarged view. The valve plug 14 tapering conically at both ends is suitable for achieving a hermetic seal of the valve opening 8 with slight axial closing power. Upon downward sliding in the direction of the arrow 24 of the discharge 19 belonging to the head part 3, together with the discharge tube 12, the valve plug 14 is moved downward and releases the valve opening 8. The valve arrangement is uncomplicated, expedient and suitable for cost-beneficial manufacture.

Figure 4:
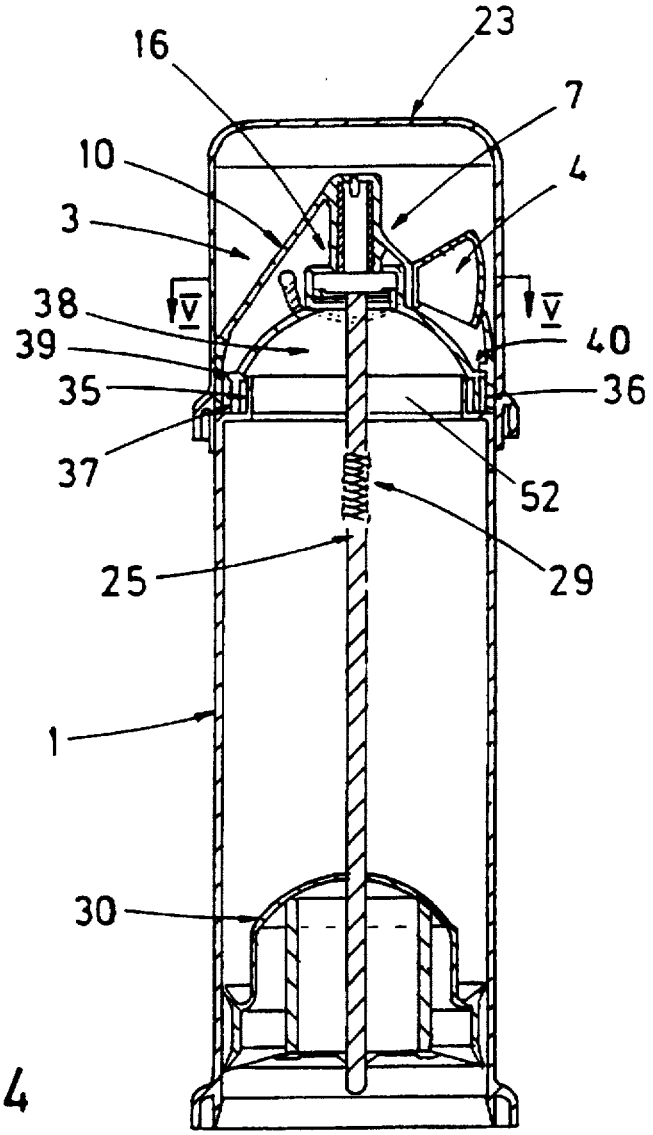
FIG. 4 shows a longitudinal section through another embodiment of the dispenser.

FIG. 4 shows a somewhat different embodiment of the dispenser. The housing 1 is open at the top 52 and at the top forms an upwardly open annular channel 35 by means of an inward set back of the housing wall and also forms a collar 36 with a clip channel 37 at the outside. The head part 3 comprises a cap 38 arched into a dome-like shape which has a lower portion introducible into the annular channel 35. The lower portion has a flange 39 that overlaps the annular channel 35, the flange 39 being held by an inner flange 40 of the applicator 10 that can be clipped onto the collar 36. This embodiment also comprises a rifling 29 at the piston rod 25. The head part of the piston 30 is formed dome-shaped in a complementary manner corresponding to the dome-shaped form of the cap 38, as a result whereof a nearly residue-free emptying of the filled contents of the dispenser is achieved. The remaining elements of the head part 3 with the valve body 7 and further elements correspond to the embodiment and arrangement of FIG. 1. Again, the cap 38 has a sufficient restoring force due to its elasticity and resiliency so as to cause it to return to its original position when the force of the push button is relieved.

Figure 5:
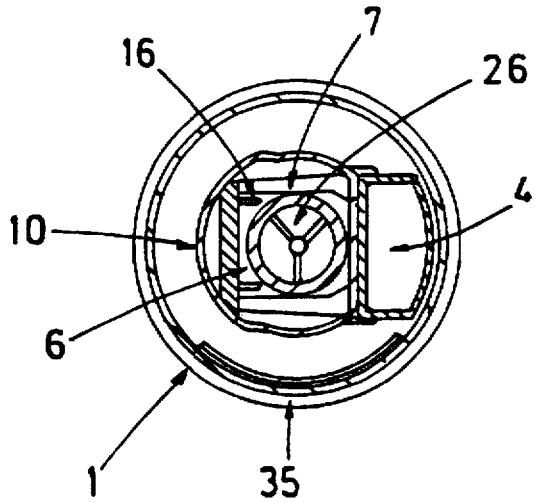
FIG. 5 shows a section through the dispenser along the plane of section V—V of FIG. 4.

In a section along the plane V—V in FIG. 4, FIG. 5 shows the connecting rod holder 26 in the form of a perforated or apertured disk within the guide cylinder 6, and also shows the arrangement of the push button 4 as well as of the applicator 10 and, further, the housing 1 with the open annular channel 35 which is only partially indicated for reasons of clarity.

Figure 6:
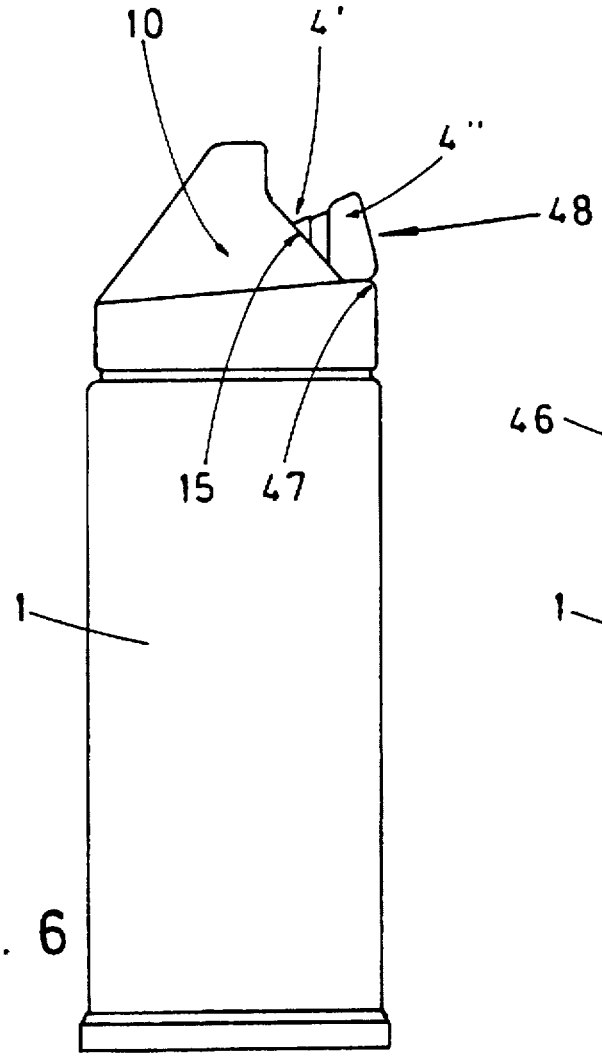
FIG. 6 shows a side elevational view of a dispenser with child-proof device.
Figure 8:
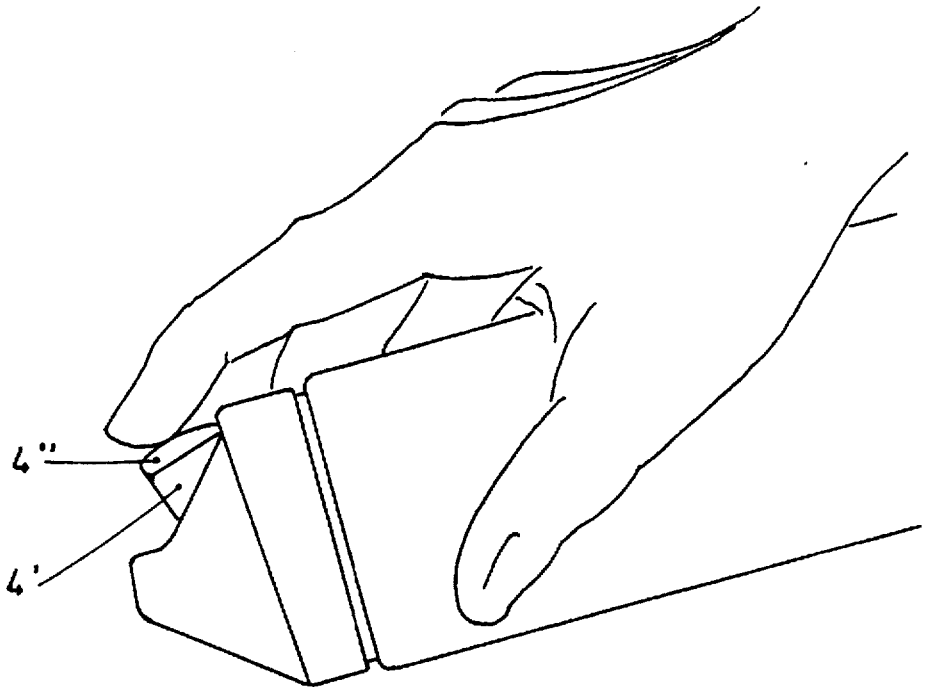
FIG. 8 shows a material illustration of a dispenser for unlocking the child-proof device.
Figure 9:
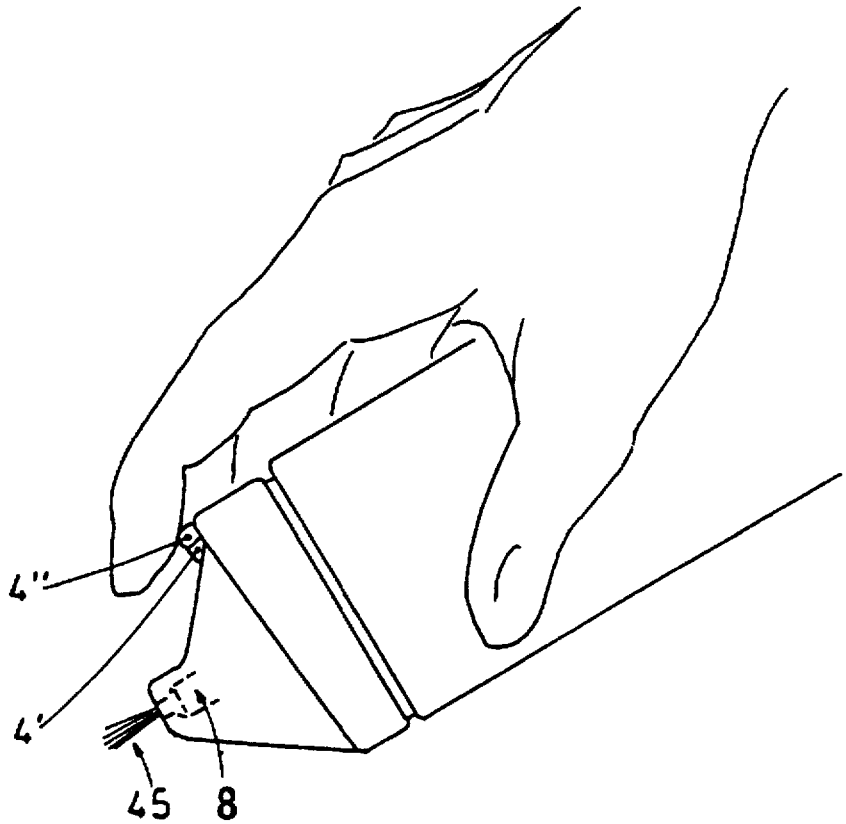
FIG. 9 shows a material illustration of a dispenser after unlocking of the child-proof device.

In a elevational side view, FIG. 6 shows a dispenser with the cap removed and a double push button 4', 4" formed as a child-resistant lock. The element 4" is displaced radially outward in the part 4', axially telescoping under the pressure of a spring into the locked condition, corresponding to the illustration in FIG. 6, and lies against an edge 47 of the clearance 15 of the applicator 10. In this condition, it is not possible to press the actuation button 4', 4" down for a working stroke. For this purpose, the part 4" must be pressed radially in telescoping fashion into the part 4' opposite the pressure of a restoring spring in the direction of the arrow 48. Only then can the push button elements 4', 4" be pressed down for a working stroke. This operation is schematically shown in FIGS. 8 and 9. In FIG. 8, the index finger first presses the part 4" radially into the push button 4' in telescoping fashion and thus unlocks the lock. Subsequently, in conformity with the illustration in FIG. 9, the push button composed of the two parts 4', 4" can be pressed down and, thus, the work stroke can be executed, whereby dispensed component 45 can then emerge from the valve opening 8.

Figure 10:
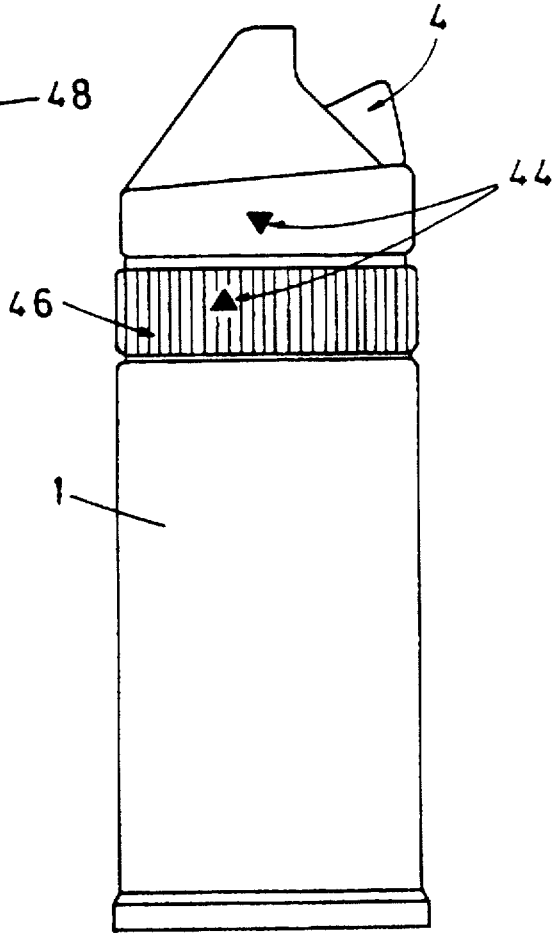
FIG. 10 shows a side elevational view of a dispenser with a different childproof device.
Figure 7:
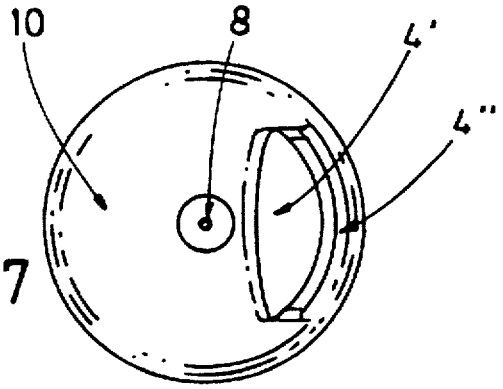
FIG. 7 shows a plan view onto the dispenser with child-proof device according to FIG. 6.

FIG. 10 shows another embodiment of the child-resistant lock. The dispenser thereby comprises a lock ring 46 at the housing 1. The lock ring 46 is fashioned such, in cooperation with the push button 4, that it only releases the push button 4 for being pressed down when the lock ring is in a specific position that can be recognized by markings 44 which can be made to coincide.

The inventive measures and embodiments are not limited to the exemplary embodiments shown in the FIGS. of the drawing. Possible modifications of the inventive device can be comprised therein that, for example, the valve and/or the reservoir have different cross sectional shapes, and in that parts are also composed of metal inside of plastics. The respective structural design is up to the discretionary of a person skilled in the art in adaptation to specific applications.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A dispenser for the controlled discharge of a fluid medium having a housing with a piston displaceable only in an emptying direction and supported against an inside wall of the housing by a locking mechanism in an opposite direction wherein a rod passes axially through the housing and interacts with the piston and further wherein a push button is provided displaceable between a first position and a second position defining a stroke therebetween wherein the push button displaces a portion of a dispensed medium through a valve that can be opened and closed upon actuation of the push button, the dispenser comprising:

a head arranged to be pressed down by the stroke of the push button wherein the push button is positioned adjacent to the head part to engaged and to displace the head part such that the valve can be opened and closed with the actuation of the push button; and a holder in the form of an apertured, radial disk holding the rod with little axial free-float in a guide cylinder and also comprising an end part facing toward the piston non-positively coupled to the piston upon interposition of an inner locking mechanism formed by the piston floor.

2. A dispenser according to claim 1, wherein said housing forms a neck with a reduced diameter at its upper edge region, said neck accepting an applicator, whereby said applicator comprises a cylindrical cap opening toward said neck and being provided with a valve opening at an end of a cylindrical passage, said head part having a small tube that extends upward into said cylindrical passage and forms a part of the valve glides axially displaceable in telescoping fashion sealed with a seal bead, said small tube carrying a valve plug at star-shaped arms at its tip.

3. A dispenser according to claim 1, wherein said applicator comprises a lateral opening within which said push button is arranged, whereby said push button, at a point opposite said opening, is movably hinged to gusset-like ribs formed inside said applicator.

4. A dispenser according to claim 1, wherein said push button comprises a stop bead at its outside which is formed as an element for limiting a stroke distance for said push button.

5. A dispenser according to claim 1, wherein said head part comprises a flat housing cover deflectable by said push button having said guide cylinder lying thereabove and comprises a discharge that tapers funnel-like upwardly from said guide cylinder and has a valve tube put in place thereon.

6. A dispenser according to claim 5, wherein said connecting rod is upwardly extended beyond said holder and projects into said discharge and carries a pluggable centering plate at its end.

7. A dispenser according to claim 1, wherein said connecting rod comprises a rifling at a region below said open end of said housing.

8. A dispenser according to claim 1, wherein said housing comprises a stand base, a supply cylinder, a neck, a cover and said head part which are integrally composed of medium-hard thermoplastic material.

9. A dispenser according to claim 1, wherein said piston, an applicator, said push button, a cap and said connecting rod are composed of a hard thermoplastic material.

10. A dispenser according to claim 1, wherein said housing at said open end forms an upwardly open annular channel set back inward in diameter thereat and, at the outside, comprises a collar with a clip channel, and said head part comprises a cover arched dome-like that can be placed into said annular channel and has a flange extending over said annular channel, said flange being held by an inner flange of said applicator that is clipped to said collar.

11. A dispenser according to claim 1, wherein said dispenser includes a child-resistant lock, whereby said push button is formed of two parts having a telescopable lock key deflectable with a restoring force that, before the push button is pushed down, can be unlocked by pressure in a direction opposite a restoring force of a spring.

12. A dispenser according to claim 1, wherein said dispenser includes a child-resistant lock comprising a lock ring that releases said push button for being pushed down when said ring is rotated to a predetermined position.

* * * * *